United States Patent [19]

Hull

[11] 4,319,687

[45] Mar. 16, 1982

[54] BATHROOM AND KITCHEN FIXTURES

[76] Inventor: James R. Hull, 148 S. Westgate Ave., Los Angeles, Calif. 90049

[21] Appl. No.: 202,335

[22] Filed: Oct. 30, 1980

Related U.S. Application Data

[63] Continuation of Ser. No. 87,203, Oct. 22, 1979, abandoned.

[51] Int. Cl.[3] ..... A47F 7/00

[52] U.S. Cl. ..... 211/105.2; 242/55.2

[58] Field of Search ..... 211/105.2, 6; 242/55.2; D6/97

[56] References Cited

U.S. PATENT DOCUMENTS

| | | | |
|---|---|---|---|
| D. 155,897 | 11/1949 | Huntington | D6/97 |
| 1,019,662 | 3/1912 | Kroder | 211/105.2 |
| 2,240,629 | 5/1941 | Smith | 242/55.2 |
| 2,434,368 | 1/1948 | Pederson | 242/55.2 |
| 3,067,963 | 12/1962 | Suggs | 242/55.2 |
| 3,384,333 | 5/1968 | Bohlman et al. | 248/251 |
| 3,593,936 | 7/1971 | Davis | 242/55.2 |
| 4,218,027 | 8/1980 | Pool | 242/55.2 |

*Primary Examiner*—Ramon S. Britts
*Assistant Examiner*—Robert W. Gibson, Jr.
*Attorney, Agent, or Firm*—Keith D. Beecher

[57] ABSTRACT

A bathroom and kitchen fixture is provided, which comprises a bent tubular member, and which includes a bushing-like tubular bracket whose outer diameter corresponds to the inner diameter of the tubular member, the bracket extending into one end of the tubular member to mount the tubular member on the wall. The fixture is shaped to constitute a toilet paper or paper towel holder.

2 Claims, 3 Drawing Figures

BATHROOM AND KITCHEN FIXTURES

This application is a continuation of Copending Application Ser. No. 87,203 filed Oct. 22, 1979 abandoned.

BACKGROUND

The principal objective of the invention is to utilize a simple concept of a bent tubular member, and a bushing-like tubular bracket which is received in one end of the bent tubular member to mount the tubular member on a wall, the tubular member being configured to form a holder for toilet paper or paper towels.

The fixture of the invention is a clean-cut contemporary fixture, and is based on the simplicity and functionality of a tube. The tube is flush-mounted to the bathroom or kitchen wall by means of a simple tubular bushing-like bracket, which is attached to the wall by a single screw.

The tube, in constructed embodiments of the invention, is made of solid polished brass and durable, heavy gage steel tubing. The tube may either be chrome-plated, or it may be permanently colored with a tough, fused plastic coating electrostatically bonded to the tube. However, the concept of the invention is not limited to any particular material or coating for the tube.

DETAILED DESCRIPTION OF THE ILLUSTRATED EMBODIMENT

Figure 1:
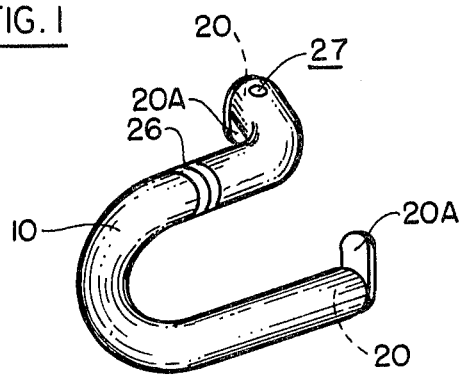
FIG. 1 is a perspective view of one embodiment of the invention, in which the tube is shaped and supported to constitute a toilet paper holder.

In FIG. 1 the U-shaped member 10 has one end supported on the wall by means of a first plug 20, and the tubular member is shaped to constitute a holder for toilet paper or for a paper towel roll. A second plug 20 is inserted into the free end of the U-shaped tubular member 10. The plugs 20 each have a flange 20A. The flange 20A of the second plug 20 extends upwardly to constitute a retainer for the roll of paper on the holder, and the flange 20A of the first plug may be screwed to the wall to prevent rotation of the holder.

The U-shaped member 10 of the holder of FIG. 1 may actually be formed of two sections, as shown, with the sections being intercoupled by an appropriate coupler 26, to enable the remote section, which actually supports the roll of paper, to be turned relative to the section which is attached to the wall.

Figure 2:
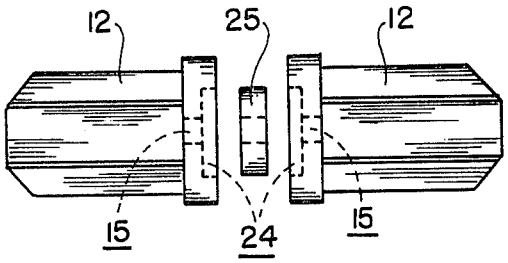
FIG. 2 is an exploded side view of a coupler used in the holder of FIG. 1.
Figure 3:
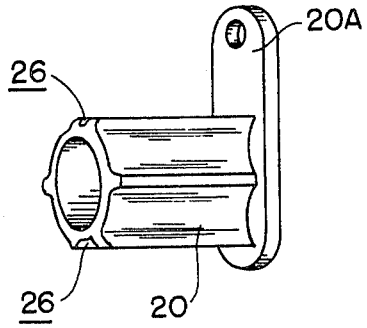
FIG. 3 is a perspective representation of a plug which is used as a retainer in conjunction with the toilet paper holder of FIG. 1 and which also can be used as a mounting bracket, when a flange is necessary to prevent the tubular member from turning, such as is the case with the toilet paper holder of FIG. 1.

The section of the U-shaped bracket 10 in FIG. 1 which is adjacent to the wall includes an elbow with holes, such as hole formed in its top and bottom directly above the flange 20A of wall mounting plug 20. Plug 20 has slots such as slots 26 (FIG. 3) which receive screws through the holes such as hole 27 in FIG. 1 to prevent rotation of the holder. A coupler 26 (FIG. 2) consists of two plugs 12 which are fastened together in back-to-back relationship with an aluminum pop rivet, or other suitable fastener. The plugs 12 are aligned by means of a washer 25 that nests in a shallow depression 24 in the end of each plug 12. The rivet (not shown) extends through the holes 15 in the plug and through the washer 25. This plug allows 360° rotation of the remote section of bracket 10, which makes either right or left hand mounting possible and extends the usefulness of the holder.

The invention provides, therefore, a simple concept of a bent tubular member and a flush tubular-like mounting bracket, in which the tubular member may be formed into a predetermined shape to constitute a fixture for toilet paper or paper towels, as described above.

It will be appreciated that although a particular embodiment of the invention has been shown and described, modifications may be made. It is intended in the claims to cover all the embodiments which come within the true spirit and scope of the invention.

What is claimed is:

1. A fixture comprising: a bent tubular member constituting a holder for a roll of paper; a tubular bushing-like mounting bracket configured to fit into one end of said bent tubular member to mount the tubular member on a wall, said bent tubular member having a U-shape and having a free end displaced outwardly from the plane of the wall, said tubular member being in sections; coupling means interposed between the two sections of said tubular member to couple the sections together and to permit the sections to be turned relative to one another, said coupling means comprising a pair of said mounting brackets extending into the respective adjacent ends of the two sections, and means securing said pair of mounting brackets together in aligned coaxial relationship; and a base for said first-named mounting bracket for engaging the surface of the wall, said base extending radially beyond the peripheral surface of said bracket, and a mounting screw extending through the base and into the wall for attaching the bracket to the wall.

2. The fixture defined in claim 1, and which includes a plug inserted into said free end of said tubular member, said plug having a flange extending upwardly to constitute a retaining means for the roll of paper.

* * * * *